US006187111B1

(12) United States Patent
Waka et al.

(10) Patent No.: US 6,187,111 B1
(45) Date of Patent: Feb. 13, 2001

(54) VACUUM CARBURIZING METHOD

(75) Inventors: Masaomi Waka; Toru Kadono; Satoshi Harai; Tetsuya Okada; Naoaki Imai, all of Toyama (JP)

(73) Assignee: Nachi-Fujikoshi Corp., Toyama (JP)

( * ) Notice: Under 35 U.S.C. 154(b), the term of this patent shall be extended for 0 days.

(21) Appl. No.: 09/261,168

(22) Filed: Mar. 3, 1999

(30) Foreign Application Priority Data

Mar. 5, 1998 (JP) ..... 10-071304

(51) Int. Cl.[7] ..... C23C 8/22; C21D 1/773
(52) U.S. Cl. ..... 148/223; 148/225
(58) Field of Search ..... 148/223, 225

(56) References Cited

U.S. PATENT DOCUMENTS 5,205,873 4/1993 Faure et al. .
5,702,540 12/1997 Kubota .

*Primary Examiner*—Deborah Yee
(74) *Attorney, Agent, or Firm*—Venable; Robert J. Frank; Gabor J. Kelemen

(57) ABSTRACT

An improved vacuum carburizing method is provided which is easy to handle or to maintenance and low equipment costs without using hydrogen gas or acetylenic gas. The improved vacuum carburizing method comprises a carburizing treatment of workpieces made from steel material heated to about 900–1100° C. performed by introducing an ethylenee gas as a carburizing gas at a vacuum of 1–10 kPa in a carburizing furnace chamber.

1 Claim, No Drawings

VACUUM CARBURIZING METHOD

BACKGROUND OF THE INVENTION

1. Field of the Invention

The present invention relates to a vacuum carburizing method of parts or workpieces made from steel material.

2. Description of the Related Art

Conventional carburizing method of parts or workpieces made from steel material are widely employed for example as gas carburizing, vacuum carburizing, or plasma carburizing methods. However, gas carburizing has the problems such as safety problems due to the combustibility of the gas, a generation of grain boundary oxidation of the carburizing surfaces of parts or workpieces treated and the problem to shorten the process cycle time for the difficulty in the carburizing treatment at a high-temperature. On the other hand, plasma carburizing requires high equipment costs and is restricted to special carburizing treatments such as those of parts or workpieces having deep holes.

The conventional vacuum carburizing is performed by heating workpieces made from steel material to about 900–1000° C., and introducing a gaseous saturated aliphatic hydrocarbon including methane gas, propane gas and butane gas as a carburizing gas at a pressure of 10–70 kPa in a carburizing furnace chamber. However, the latter vacuum carburizing suffers from disadvantages including its high equipment costs, difficulty in the maintenance of the furnace due to the production of a large amount of soot and its high operating costs.

In order to reduce the operating costs of the conventional vacuum carburizing treatment, U.S. Pat. No. 5,702,540 proposes a vacuum carburizing treatment in which carburizing treatment is performed by vacuum heating workpieces from steel material in the heating chamber of a vacuum carburizing furnace, and supplying a carburizing gas to the heating chamber, employing a gaseous unsaturated aliphatic hydrocarbon comprising an acetylenic gas as the carburizing gas, and performing the carburizing treatment with the heating chamber at a vacuum of not more than 1 kPa. However, the acetylenic gas is explosive when pressure is applied, and it is difficult and troublesome to handle. Further, since a large amount of soot is produced when operated under a high vacuum pressure, the pressure is set at the vacuum of not more than 1 kPa, resulting in the need of a large volume vacuum pump or a mechanical booster pump, which leads to complicated installations and excessive equipment costs.

Further, U.S. Pat. No. 5,205,873 discloses a vacuum carburizing method for metal alloy parts using a fuel mixture gas consisting of hydrogen and ethylene gases as a carburizing gas at a pressure of 1–10 kPa in a carburizing furnace chamber. However, since this method uses lightly explosive hydrogen gas, it also suffers from disadvantages including its high equipment costs, a long process cycle and difficulty in handling so that it requires an introduction of nitrogen gas into the heating furnace chamber prior to the loading and heating the metal alloy parts.

SUMMARY OF THE INVENTION

It is therefore an object of the present invention to provide an improved vacuum carburizing method for parts or workpieces made from steel material which is easy to manipulate, which requires only low maintenance and low equipment costs and which does not involve the use of hydrogen gas or acetylenic gas.

Another object of the present invention is to provide an improved vacuum carburizing method in which it is possible to obtain a uniform carburized case depth on the surface of the workpieces as well as to reduce equipment costs by lowering the capacity of the vacuum pumps, and to improve the maintenance of the installations by decreasing the generation of soot and to reduce the consumption of carburizing gases and the operating costs.

Although the '540 patent discloses using a gaseous unsaturated aliphatic hydrocarbon including an acetylenic gas as a carburizing gas, except the acetylenic gas, no other gas, for example, an ethylene gas, is mentioned in any of the examples in the specification. Since an ethylene gas is most widely used industrially and is of low cost as the carburizing gas, applicants tested using the ethylene gas by replacing the acetylenic gas shown in the example of the '540 patent for comparison. However, the test resulted in the finding that no desirable uniform carburized case depth on the surface of the workpieces was obtained at all.

After diligent study, the applicants discovered that a uniform carburized case depth on the surface of workpieces made from steel material is obtainable by a carburizing treatment of the workpieces heated to about 900–1100° C. performed by introducing an ethylene gas ($C_2H_4$) as a carburizing gas at a vacuum of 1–10 kPa in a carburizing furnace chamber. Specifically, the applicants discovered that when using the ethylene gas, a satisfactory carburizing treatment is not obtainable if the pressure in the carburizing furnace chamber is lower than 1 kPa, and in contrast, the generation of soot is increased if the pressure exceeds 10 kPa.

Based on the above findings, the present invention solved problems, inherent in the prior art carburizing treatment methods, by providing an improved vacuum carburizing method comprising a carburizing treatment of the workpieces made from steel material heated to about 900– 1100° C. performed by introducing an ethylenee gas ($C_2H_4$) as a carburizing gas at a vacuum of 1–10 kPa in a carburizing furnace chamber.

By the vacuum carburizing method according to the invention, without using an acetylenic gas or a hydrogen gas, it is possible to obtain a uniform carburized case depth on the entire surface of workpieces, and since carburizing treatment is performed under the vacuum pressure of 1–10 kPa, the generation of soot is suppressed, resulting in easy handling and maintenance of the installations.

More particularly, since the method of the invention is performed under a vacuum of 1–10 kPa in the carburizing furnace chamber, it is possible to reduce equipment costs by lowering the capacities of the vacuum pumps without using an expensive mechanical booster pump. Additionally, by using the ethylene gas which is inexpensive and, in contrast to the acetylenic gas, is not self-explosive when pressure is applied, the operating gas costs as well as the equipment costs for the treatment are considerably decreased and a long service life thereof is insured.

DETAILED DESCRIPTION OF THE PREFERRED EMBODIMENTS

Preferred embodiments performed according to the vacuum carburizing method of the present invention will be described below.

EXAMPLE 1

Thirty (30) pieces of cylindrical solid bars made of SCM 415 (listed on the JIS G 4105) steel material or equivalent thereof having diameter: 20 mm× length: 10 mm are loaded in a vacuum carburizing furnace chamber having internal diameter: 1200 mm× length: 1500 mm (cubic capacity: about 1.7 $m^3$). Under vacuum and heated conditions of about 1000° C., an ethylene gas is introduced in the chamber at a flow rate of 1 lit/min keeping a vacuum at 3 kPa in the chamber, the carburizing treatment is conducted for about one hour (carburization: 16 minutes followed by diffusion: 44 minutes by stopping the gas supply), and then quenched in oil. During this treatment, no soot is observed. After the carburizing treatment, the cylindrical bars are taken out and chemically analyzed concerning the carbon concentration of the surfaces of the bars. This carbon concentration analysis showed the good results that a uniform and sufficient carburized case depth of the portion having the carbon concentration 0.3% prevails around about 0.9 mm from the surfaces of both side faces as well as each middle portion of the treated cylindrical bars. Further, the variations of the carburized case depths from the surfaces having the carbon concentration 0.3% fall within ±0.05 mm.

Since the carburizing vacuum is set at 3 kPa, the chamber is completely evacuated by only one vacuum pump unit having a capacity 3000 of lit/min powered by a 3.7 KW electric motor, without an expensive mechanical booster pump being necessary when an acetylenic gas is introduced as a carburizing gas.

EXAMPLE 2

Five (5) pieces of cylindrical solid bars the same as those of shown in the Example 1 which are made of SCM 415 (listed on the JIS G 4105) steel material or equivalent thereof having diameter: 20 mm×length: 10 mm are loaded in the same vacuum carburizing chamber as used in the Example 1. Under vacuum and heated conditions of about 1000° C., an ethylene gas is introduced in the chamber at a flow rate of 1 lit/min keeping the pressure at 6 kPa in the chamber, the carburizing treatment is conducted for about one hour (carburization: 16 minutes followed by diffusion: 44 minutes by stopping gas supply and maintaining a vacuum pressure less than 0. 05 kPa), and then quenched in oil. During this treatment, no soot is observed. After the carburizing treatment, the cylindrical bars are taken out and chemically analyzed concerning the carbon concentration of the surfaces of the bars. This carbon concentration analysis showed the good results that a uniform and sufficient carburized case depth having the carbon concentration 0.3 % prevails around about 0.9 mm from the surfaces of both side faces as well as each middle portion of the treated cylindrical bars. Further, the variations of the carburized case depths from the surfaces having the carbon concentration 0.3% fall within ±0.05 mm.

What is claimed is:

1. A method of carburizing steel workpieces consisting essentially of (a) placing the workpieces in a carburizing furnace chamber;

(b) producing a vacuum of 1–10 kPa in the furnace chamber;

(c) heating the workpieces to about 900–1100° C. in the furnace chamber and (d) introducing an ethylene gas as a carburizing gas in the furnace chamber.

* * * * *